US010213036B2

(12) United States Patent
Giraud-Carrier et al.

(10) Patent No.: US 10,213,036 B2
(45) Date of Patent: Feb. 26, 2019

(54) ADAPTIVE HAND TO MOUTH MOVEMENT DETECTION DEVICE

(71) Applicant: Brigham Young University, Provo, UT (US)

(72) Inventors: Christophe Giraud-Carrier, Orem, UT (US); Joshua H. West, Mapleton, UT (US); Christopher R. Fortuna, Provo, UT (US); Stephen J. Clarkson, Provo, UT (US)

(73) Assignee: Brigham Young University, Provo, UT (US)

( * ) Notice: Subject to any disclaimer, the term of this patent is extended or adjusted under 35 U.S.C. 154(b) by 413 days.

(21) Appl. No.: 14/546,582

(22) Filed: Nov. 18, 2014

(65) Prior Publication Data

US 2015/0140524 A1 May 21, 2015

Related U.S. Application Data

(60) Provisional application No. 61/962,946, filed on Nov. 19, 2013.

(51) Int. Cl.
*A47G 23/10* (2006.01)

(52) U.S. Cl.
CPC ..... *A47G 23/10* (2013.01)

(58) Field of Classification Search
USPC ..... 434/127
See application file for complete search history.

(56) References Cited

U.S. PATENT DOCUMENTS

| | | | | |
|---|---|---|---|---|
| 8,235,724 | B2 | 8/2012 | Gilley et al. | |
| 8,310,368 | B2 * | 11/2012 | Hoover | A61B 5/1123 340/573.1 |
| 8,659,418 | B2 | 2/2014 | Kreml | |
| 2012/0178065 | A1 | 7/2012 | Naghavi et al. | |

* cited by examiner

*Primary Examiner* — Kesha Frisby
(74) *Attorney, Agent, or Firm* — Brake Hughes Bellermann LLP

(57) ABSTRACT

A hand to mouth bite counting device is provided that may be worn on a hand, wrist or arm of a user to silently and continuously count the number of bites of food taken by the user. The bite counting device may include a sensing device that collects data corresponding to a sensed movement, and a processor that implements an algorithm to process the collected data and determine whether data collected within a given interval of time corresponds to a bite of food taken by the user. The processor derives a set of attributes from the data collected within the given interval of time to define the sensed movement. The device also provides feedback, goal setting functionality, and long-term statistics to serve as a dietary aid.

20 Claims, 9 Drawing Sheets

ADAPTIVE HAND TO MOUTH MOVEMENT DETECTION DEVICE

CROSS REFERENCE TO RELATED APPLICATION

This application claims priority to Provisional Application Ser. No. 61/962,946 filed on Nov. 19, 2013, the entirety of which is incorporated by reference as if fully set forth herein.

FIELD

This disclosure relates, generally, to a device that can count a number of hand to mouth (HTM) movements.

BACKGROUND

Personal electronic devices may be used for scientific as well as non-scientific applications. For example, individuals seeking to monitor physical activity may use a personal electronic device to monitor physical activity, to track/document progress, and to provide motivation for increased physical activity. The capability to monitor and track food and beverage intake using a personal electronic device, in an effective and affordable manner, may be advantageous in achieving weight control goals.

SUMMARY

In one aspect, a hand to mouth bite counting device, in accordance with embodiments broadly described herein, may include a sensing device included in a housing, the sensing device continuously collecting data corresponding to sensed movements of at least some portion of an arm of a user, a processor operably coupled to the sensing device to determine whether data collected by the sensing device throughout the sensed movement corresponds to a bite of food taken by the user, and an interface device operably coupled to the processor, the interface device providing for communication between the user and the processor. A set of attributes may be derived from the data collected within the predetermined interval of time, the set of attributes defining the sensed movement from an initial point at which the movement is initially sensed to a terminal point at which the movement has terminated.

In another aspect, an operation method for a hand to mouth bite counting device, the hand to mouth bite counting device including a sensing device in communication with a processor, may include activating the sensing device and continuously collecting data in response to sensed movement of at least a portion of an arm of a user, from an initial point at which the movement is sensed to a terminal point at which the movement is terminated, and transmitting the collected data to the processor, and implementing an algorithm on the collected data. The algorithm may include processing the data collected during a plurality of intervals of time, deriving a set of attributes for a first interval of time, of the plurality of intervals of time, from the data collected during the first interval of time, the set of attributes defining the movement sensed during the first interval of time from the initial point to the terminal point of the sensed movement, and processing the set of attributes and determining whether the movement sensed during the first interval of time is a bite of food taken by the user.

The details of one or more implementations are set forth in the accompanying drawings and the description below.

Other features will be apparent from the description and drawings, and from the claims.

DETAILED DESCRIPTION

A personal electronic device may be used by individuals to collect data related to, for example, diet/weight control, such as losing weight, gaining weight, or maintaining a desired weight or a desired intake level of nutrients. Data collected in this manner may be used to track progress, establish/revise goals, facilitate competitive challenges among peers, and the like to provide motivation in achieving weight management goals. A hand to mouth (HTM) counter, in accordance with embodiments as broadly described herein, may provide an affordable, effective tool to collect objective measures of diet through automatic, individualized monitoring of intake based on monitoring of hand to mouth movements of the individual.

An algorithm and methodology of the HTM counter could run on any device capable of incorporating the appropriate hardware and software elements. In one example implementation, the HTM counter may be incorporated into a device worn on a wrist of a user, in the form of, for example, a wrist watch or a bracelet. In this arrangement, such a watch or bracelet could be worn on the same wrist of the user, day and night, e.g., continuously, to provide for consistent data collection by silently and constantly counting a number of hand to mouth movements made by the user that correspond to actual bites taken by the user, without specialized user interaction and/or manipulation. Application of the HTM counter is not limited to such a wrist watch or bracelet, and other types of hardware implementations may also be appropriate.

Figure 1:
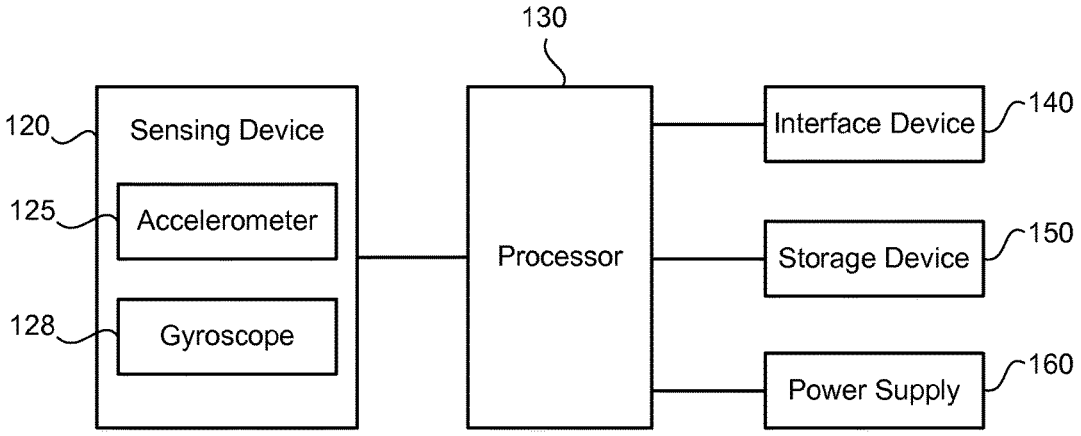
FIG. 1 is a block diagram of a hand to mouth counter, in accordance with embodiments as broadly described herein.

FIG. 1 is a block diagram of an example HTM counter, in accordance with an embodiment as broadly described herein. The HTM counter 100 may include a sensing device 120 in communication with a processor 130. The sensing device 120 may include, for example, an accelerometer 125 and a gyroscope 128, to sense and/or collect hand to mouth movement data. The processor 130 may receive and process the data collected by the sensing device 120 and provide the processed data to the user via, for example, an interface device 140. The processor 130 may store the processed data, as well as other data, such as, for example, settings and other operating type information, in a storage device 150. A re-chargeable power supply 160 may supply power to the HTM counter 100. The HTM counter 100 shown in FIG. 1 is merely an example implementation, and an HTM counter as embodied and broadly described herein may include additional, or fewer, components. For example, other types of elements that can be included in the sensing device 120 may include an infrared sensor, and other such elements.

Figure 2:
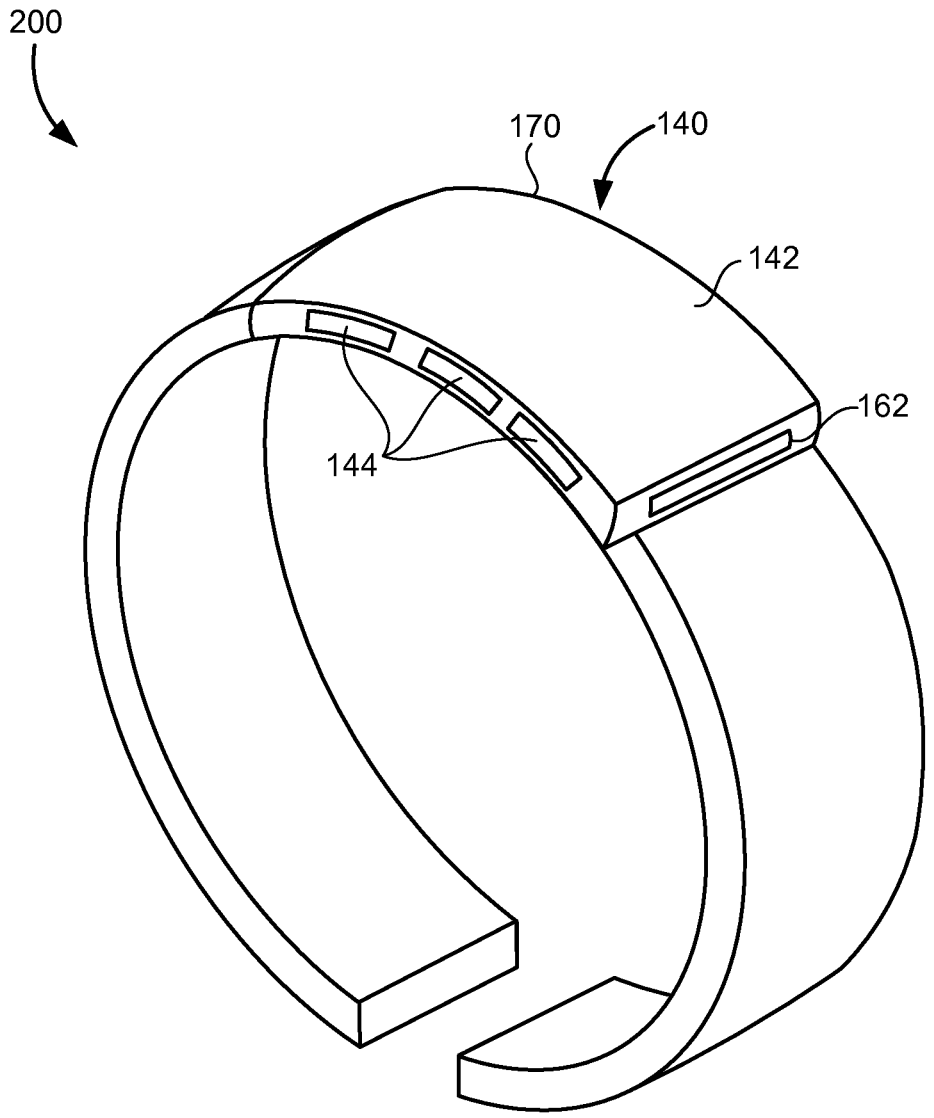
FIG. 2 is a perspective view of an implementation of a hand to mouth counter in a wrist worn device, in accordance with embodiments as broadly described herein.

As shown in FIG. 2, the HTM counter 100 may be included in, for example, a wrist worn device, with the components of the HTM counter 100 received in a housing 170. The interface device 140 may include, for example, a display 142 which may display to the user, for example, a current status, historical information, projected information, and the like. The display 142 may also facilitate user interaction with the HTM counter 100 together with, for example, manipulation devices 144 including, for example, buttons, toggles, switches and the like. A port 162 may provide for connection to, for example, an external power source for charging of the power supply 160. The HTM counter 100 may communicate with external devices in a wireless manner to, for example, download collected data for external processing and manipulation and/or viewing by the user, re-setting of collection parameters and the like. In some embodiments, the HTM device 100 may also be connected to an external device via the port 162.

Regardless of the particular hardware implementation of the HTM counter, hereinafter the combination of the algorithm, bite detection software and appropriate hardware implementation will be collectively referred to as the "device," or "HTM device," simply for ease of discussion.

In some embodiments, the HTM device may be a stand alone device worn on some portion of the arm, wrist or hand of the user, such as, for example, the HTM device 200 including the HTM counter 100 shown in FIG. 2, for the sole purpose of collecting and processing hand to mouth bite data. In some embodiments, the HTM counter 100 may be included in a hand, arm or wrist worn device, such as, for example, a watch as, for example, the HTM device 200 including the HTM counter 100 shown in FIG. 2, which may include the functionality of the HTM counter 100, in addition to other functionality. In some embodiments, the HTM device 200 may provide an indication of a current bite count to the user via, for example, the display 142, which may also be manipulated to, for example, reset the bite counter or change a manner in which the information is displayed, using, for example, the manipulation devices 144 in conjunction with the display 142, and/or connection to an external computing device (not shown in FIG. 2), either in a wireless manner or through the port 162 that provides for interface with the external computing device. Such an external computing device may include, for example, a smart phone, a tablet device, a notebook computer, a desktop computer, and the like. This type of connection may facilitate the download of data that has been collected by the HTM device 200, and the processing and presentation of the data to the user in a form appropriate for the user's analysis of the data. The data may be processed and presented to the user using an application downloaded to the computing device for this purpose. Such an application may present to the user, via a graphical user interface, current and historical data collected by the HTM device 200 in the form of, for example, graphs and charts depicting number of bites taken over a particular period of time. In some embodiments, such an application may also compute estimated caloric/nutritional content information associated with the bite information. The user may also be able to view historical data, view comparative data in which actual bites taken is compared to a suggested number of bites for a given goal, generate predictive data, review and adjust goals, set thresholds for warning notifications, and the like, and update the HTM device 200 accordingly through this connection with the computing device.

Regardless of the specific implementation of the HTM device 200, the HTM device 200 may be capable of operation in multiple different modes. For example, the HTM device 200 may be pre-programmed with a recognition model that is operational out of the box. In this initial operation mode, the HTM device 200 may begin collecting bite data as soon as it is worn by the user and turned on. In some embodiments, the HTM device 200 may also operate in a learning mode, in which the HTM device 200 learns from the individual user's own bite motions and patterns to tailor the pre-programmed recognition model to each individual user. In the learning mode, the HTM device 200 may request confirmation from the user whether a detected movement/series of movements constitute an actual bite/series of bites, and continually update the recognition model accordingly. A period of operation in the learning mode can be sustained as long as necessary to achieve a desired level of accuracy when comparing bites detected by the HTM device 200 to actual bites confirmed by the user. This allows the HTM device 200 and recognition model to be completely personalized to individual users, and could allow for periodic updates as a user's bite motions may change in different circumstances or over time, as intermediate weight management goals are achieved and re-set. The HTM counter 100/HTM device 200 may also detect when its accuracy is falling below acceptable levels that may be, for example, preset during fabrication or set and changed by the user as appropriate, and may determine which motions to request the user to perform to update and improve the model, using active learning techniques.

This real time feedback allows accuracy of the recognition model to be continuously improved, taking into account the full bite motion of the hand and arm toward the mouth, including the roll, pitch and yaw of the full movement to classify a detected movement in one or more of the X, Y and/or Z directions as an actual bite, and to update the model to reflect numerous different combinations of roll, pitch and yaw through the entirety of the movement, when confirmed by the user, to reflect actual bites. This level of granularity, coupled with the operation period in the learning mode, allows the HTM device 200 to more clearly distinguish between a hand/arm motion that is an actual bite taken by the user, and a hand/arm motion that may be similar in duration and/or direction, but is not an actual bite. This, in turn, allows the HTM device 200 to be worn by the user throughout the day, e.g., even between meals, spanning several meals, throughout a full day or series of days, with components of the sensing device 120 (for example, an accelerometer 125 and a gyro 128) remaining operational and collecting data in response to sensed movement whenever the device is on, and the processor 130 running and processing data collected by the sensing device 120 whenever the device is on, with essentially no user interaction required (outside of operation of the HTM device in the learning mode).

For example, because of this level of accuracy, there is no need to turn the device on at the start of the meal, and off at the end of the meal, as the HTM device 200 can effectively discriminate between bites and non-bites. This also allows the HTM device 200 to track not just planned bites/eating, during a meal, but also to track opportunistic bites/eating, such as snacking throughout the day, without excessive events of mis-identification/false classification of bites versus non-bites.

The recognition model used by the HTM device 200 may also be tailored for a particular user, for example, during operation in a personalization mode that may be either separate from or a part of the learning mode, to reflect age, gender, nationality, right or left handedness, preferred meal times, preferred cuisine/meals, preferred eating utensils including for example chopsticks, and other such personalized features.

In some embodiments, the HTM device 200 may also request that the user perform a set of basic learning motions when initializing the device, either before or after the device has collected information regarding these types of personalized features, again, in operation in the personalization mode, to allow the device to positively capture, for example, frequently used, known motions. Inclusion of these types of personalized features may render the time spent in the learning mode more efficient or shorter, and may render an even more accurate result.

Figure 3A:
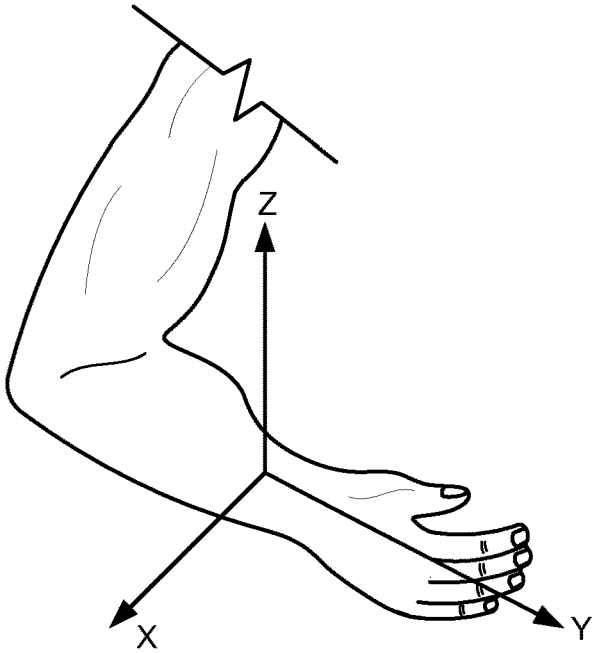
FIGS. 3A and 3B illustrate X-, Y- and Z axis coordinates, and pitch, roll and yaw movements about the X-Y and Z axes, respectively, associated with a hand to mouth movement measured by a hand to mouth counter, in accordance with embodiments as broadly described herein.
Figure 3B:
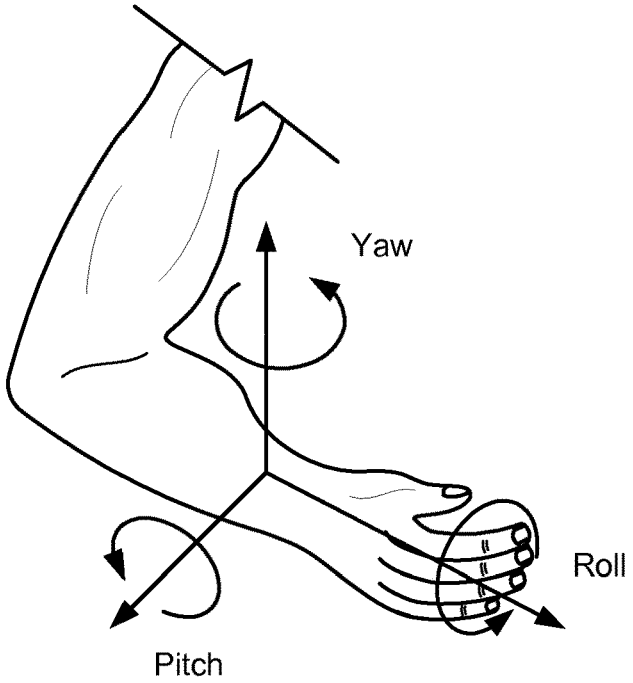

To accurately capture the entire bite motion as described above, and collect data associated with the user's hand/arm movement to be matched with the recognition model, in one embodiment, the sensing device 120 of the HTM counter 100 may include, for example, one or more accelerometers 125 to detect/measure to measure movement and velocity/acceleration through the detected movement, and one or more gyroscopes 128 to detect orientation/direction of the detected movement. As noted above, the components of the sensing device 120 may remain operational whenever the device is on, always ready to collect data in response to sensed motion whenever the device is on, which may then be processed by the processor 130 to determine whether the sensed motion constitutes an actual bite. As shown in FIG. 3A, the accelerometer(s) 125 may detect movement of the user's hand/lower arm in the X-direction, the Y-direction and the Z-direction. The gyroscope(s) 128 may detect movement and associated velocity/acceleration experienced during a roll, pitch and yaw movement of the user's hand/lower arm. Roll may be detected as the user's hand/lower arm rotates about a rotational axis corresponding to the user's lower arm. Pitch may be detected as the user's hand/lower arm rotates up and down, about the elbow, essentially in the ±Z-direction. Yaw may be detected as the user's hand/lower arm rotates side to side, about the elbow, essentially in the ±X-direction.

FIGS. 4A-4D illustrate an example of a hand to mouth movement during a bite. Although the example hand to mouth movement shown in FIGS. 4A-4D illustrates a user grasping and eating a hand held food item 10, such as, for example, a cookie or a piece of fruit, the same principles associated with the hand to mouth movement may also be applied when the user uses a hand held implement, such as, for example, a fork, a spoon or a chopstick, to pick up and move the food item to a bite position.

Figure 4A:
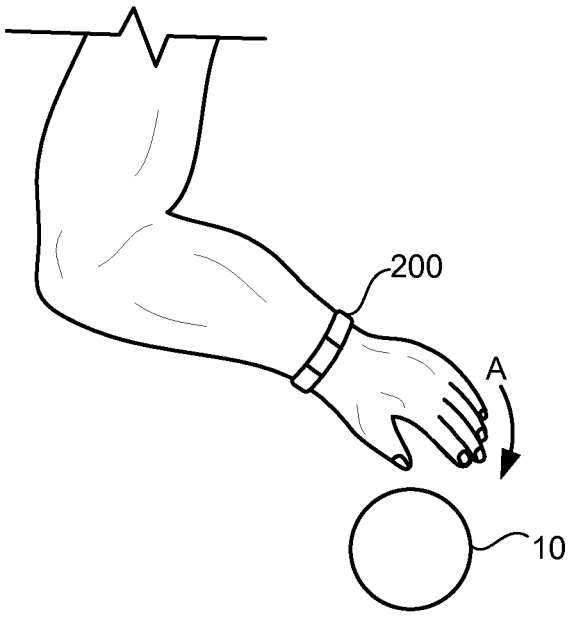
FIGS. 4A-4D illustrate an example of a hand to mouth movement for which data may be collected by a hand to mouth counter, in accordance with embodiments as broadly described herein.
Figure 4B:
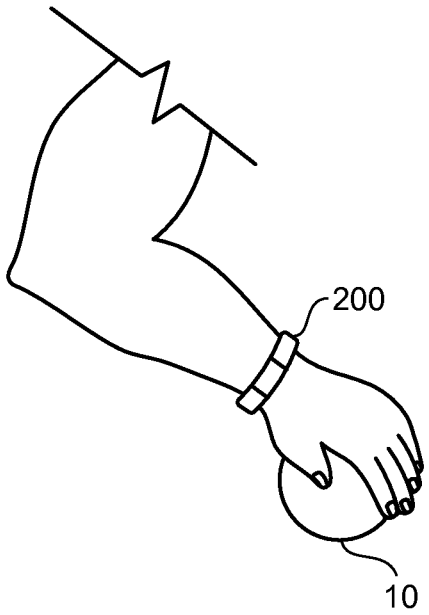
Figure 4C:
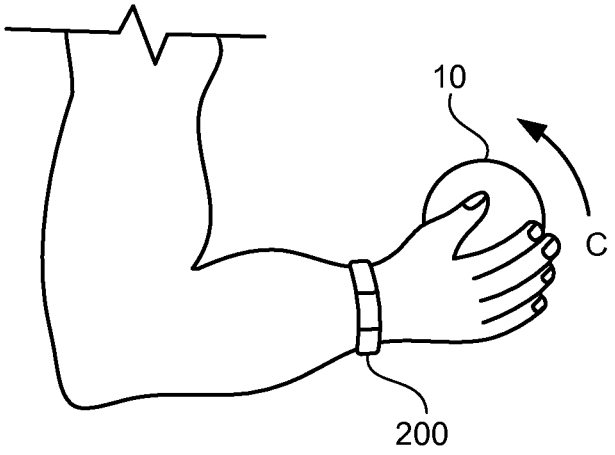
Figure 4D:
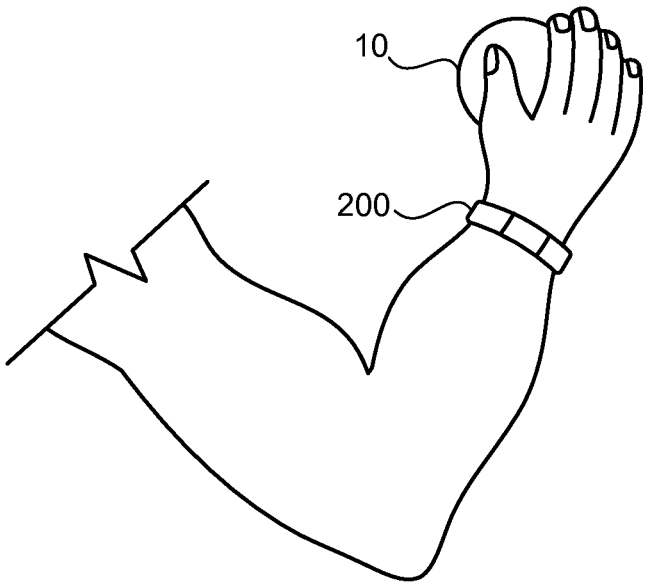

In FIG. 4A, the user's hand/lower arm move in the direction of the arrow A, toward the food item 10. During this initial portion of the hand to mouth movement, the sensing device 120 collects data associated with this portion of the movement. In FIG. 4B, as the user's hand reaches the food item 10, the movement is momentarily paused as the user grasps the food item. In an example in which a hand held eating implement is used, the movement would be momentarily paused and momentarily change direction as the user loads the food item onto the hand held eating implement. Again, during this portion of the movement, the sensing device 120 continues to collect data, and in particular, data associated with the sensed movement. In FIG. 4C, the user's hand/lower arm move in the direction of the arrow C, toward the user's mouth, as the sensing device 120 continues to collect data associated with this portion of the movement. In FIG. 4D, the hand to mouth movement is once again paused as the user's hand, holding the food item 10, approaches the user's mouth, and the movement is paused as the user takes a bite. During this final portion of the hand to mouth movement, the sensing device 120 collects data associated with this portion of the movement.

The data collected by the sensing device 120, including the accelerometer(s) 125 and gyroscopes(s) 128, during the movements shown in FIGS. 4A-4D is processed by the processor 130. The processor 130 then determines whether the movement represented by this data constitutes an actual bite, as defined by the base recognition model, which has been updated/personalized based on data collected during operation in the learning mode and/or personalization mode as well as initial input parameters provided by the user.

In refining the initial base algorithm to recognize bites, discriminate between bites and non-bites, and monitor and count bites with little to no user intervention, the initial base algorithm, or base recognition model, was subjected to a series of sample training sessions. During these training sessions, greater than 20 subjects wore the device loaded with the initial base algorithm, with the device collecting data through greater than 40 trial meals including greater than 3700 bite instances. During each sample training session, each subject wore a wrist mounted device equipped with a triaxial accelerometer and gyroscope motion sensing device to capture and record eating motions. In the initial training sessions, including greater than 5 meals, subjects pushed a button on the wrist mounted device before a bite was taken to positively mark and record each bite taken. In subsequent training sessions, including greater than 40 meals, video was used to mark bites taken by these subjects, to capture a more natural hand/arm movement during bites. These series of sample training sessions constituted greater than 3700 individual bite instances for which accelerometer X-, Y- and Z-axis data and gyroscope roll-pitch-yaw data was collected at between 1 Hz and 60 Hz. For initialization purposes, data may be collected at, for example, 10 Hz, or other frequency that may be appropriate for a particular implementation/particular user. Under circumstances in which data recording is broken into ten second segments for bite recognition, the example bite motion shown in FIGS. 4A-4D may span an approximate 10 second time interval. An example of a 10 second recording of the data collected by the accelerometer(s) 125 and gyroscope(s) 128 for a bite motion such as the example of FIGS. 4A-4D is shown in FIG. 5.

Figure 5:
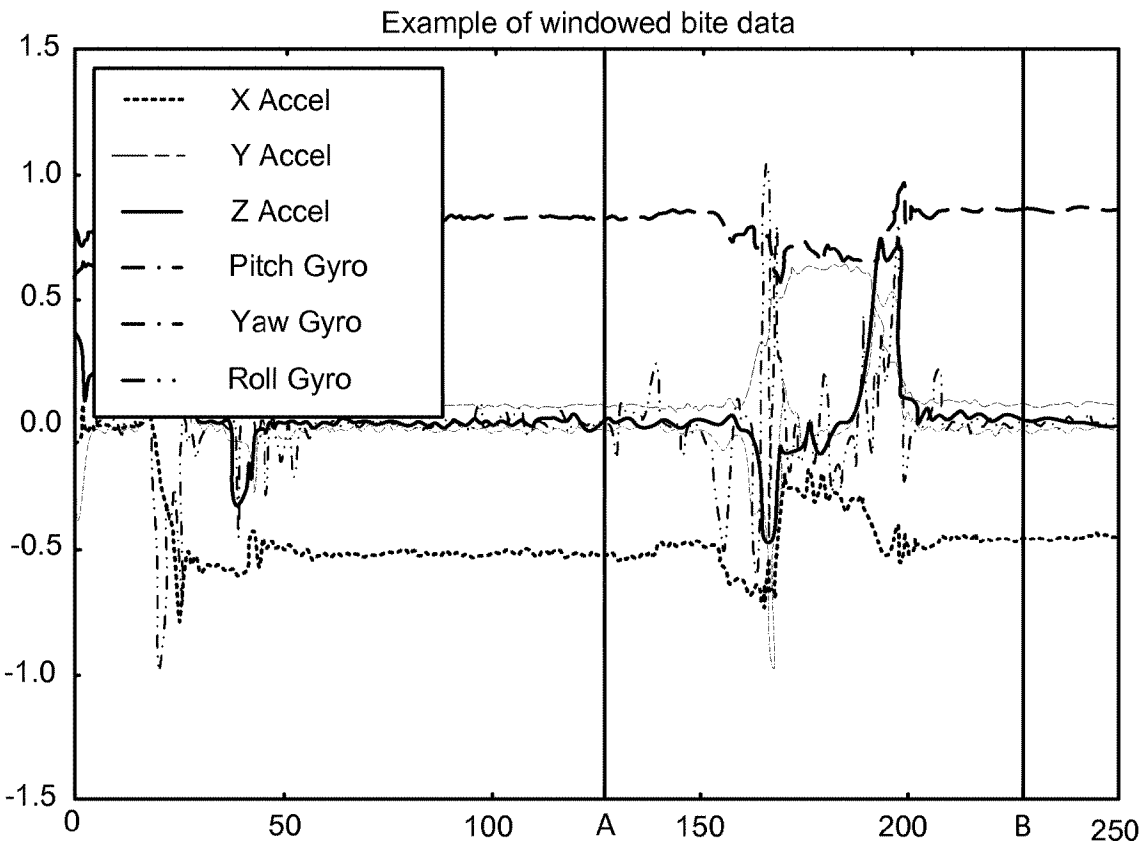
FIG. 5 is a graph of data collected through an example hand to mouth movement by a sensing device of a hand to mouth counter, in accordance with embodiments as broadly described herein.

In the example shown in FIG. 5, the x-axis is measured in tenths of a second, so the window of data captured between the vertical line A and the vertical line B represents 10 seconds. This sample of motion data is representative of a typical bite for a specific user, with the X, Y, and Z accelerometer axis making large dips or spikes in either the positive or negative directions at the same time in the middle of the bite motion. One or more elements of the pitch/yaw/roll gyroscope are also making a large negative dip before the corresponding X/Y/Z curves, as well as another large positive spike after the corresponding X/Y/Z curves. The sample data representing this sample motion basically includes a relatively large dip measured by the gyroscope, followed by relatively large dips/spikes from the accelerometer, followed by a relatively large spike from the gyroscope to complete the motion. Bite motions may vary from this sample data pattern, but the data shown in FIG. 5 provides a good general template for a sample bite motion. In some circumstances, the data representing a bite motion may also include periods of what appear to be lower activity levels before a bite motion is initiated and after a bite motion is completed, as shown in FIG. 5. In some circumstances, bites may occur during periods of much more dynamic movement, depending on the patterns of a particular user, the environment, the time of day, and numerous other factors. In general, the lower activity level experienced before and after the window may be relatively common for many bite motions however. Detection accuracy may also be somewhat dependent on the general shapes of the curves generated by the data collected during the bite window and how they relate to the surrounding data.

Based on these sample training sessions, the processor may process each hand to mouth motion detected by the device and characterize these detected motions by a relatively large number of statistical features. For example, when the sensing device 120 detects that a motion has been initiated, for example, in a direction consistent with movement of the hand toward the mouth of the user, the sensing device 120 collects data that characterizes the sensed movement based on these features. In some embodiments, the sensing device 120 continuously collects this data, which may be segmented into given intervals of time, such as for example, approximately 10 seconds, which may correspond to an approximate duration of a hand to mouth movement constituting a bite of food taken by a user. A sample of the features which may be used to characterize this movement are shown in Table 1 below.

TABLE 1

| mean | |
|---|---|
| xmean | xmean50 |
| ymean | ymean50 |
| zmean | zmean50 |
| pitchMean | pitchMean50 |
| yawMean | yawMean50 |
| rollMean | rollMean50 |
| meanXMeanYRatio | meanXMeanYRatio50 |
| meanYMeanZRatio | meanYMeanZRatio50 |
| meanZMeanXRatio | meanZMeanXRatio50 |
| meanPitchMeanYawRatio | meanPitchMeanYawRatio50 |
| meanYawMeanRollRatio | meanYawMeanRollRatio50 |
| meanRollMeanPitchRatio | meanRollMeanPitchRatio50 |
| xstd | xstd50 |
| ystd | ystd50 |
| zstd | zstd50 |
| pitchStd | pitchStd50 |
| yawStd | yawStd50 |
| rollStd | rollStd50 |
| xyCov | xyCov50 |
| xzCov | xzCov50 |
| yzCov | yzCov50 |
| xPitchCov | xPitchCov50 |
| xYawCov | xYawCov50 |
| xRollCov | xRollCov50 |
| yPitchCov | yPitchCov50 |

TABLE 1-continued

| mean | |
|---|---|
| yYawCov | yYawCov50 |
| yRollCov | yRollCov50 |
| zPitchCov | zPitchCov50 |
| zYawCov | zYawCov50 |
| zRollCov | zRollCov50 |
| pitchYawCov | pitchYawCov50 |
| pitchRollCov | pitchRollCov50 |
| yawRollCov | yawRollCov50 |
| xSpecEntropy | xSpecEntropy50 |
| ySpecEntropy | ySpecEntropy50 |
| zSpecEntropy | zSpecEntropy50 |
| pitchSpecEntropy | pitchSpecEntropy50 |
| yawSpecEntropy | yawSpecEntropy50 |
| rollSpecEntropy | rollSpecEntropy50 |
| xSignalEnergy | xSignalEnergy50 |
| ySignalEnergy | ySignalEnergy50 |
| zSignalEnergy | zSignalEnergy50 |
| pitchSignalEnergy | pitchSignalEnergy50 |
| yawSignalEnergy | yawSignalEnergy50 |
| rollSignalEnergy | rollSignalEnergy50 |
| xSignalEnergyMean | xSignalEnergyMean50 |
| ySignalEnergyMean | ySignalEnergyMean50 |
| zSignalEnergyMean | zSignalEnergyMean50 |
| pitchSignalEnergyMean | pitchSignalEnergyMean50 |
| yawSignalEnergyMean | yawSignalEnergyMean50 |
| rollSignalEnergyMean | rollSignalEnergyMean50 |
| varianceX | varianceX50 |
| varianceY | varianceY50 |
| varianceZ | varianceZ50 |
| variancePitch | variancePitch50 |
| varianceYaw | varianceYaw50 |
| varianceRoll | varianceRoll50 |
| minX | minX50 |
| minY | minY50 |
| minZ | minZ50 |
| minPitch | minPitch50 |
| minYaw | minYaw50 |
| minRoll | minRoll50 |
| maxX | maxX50 |
| maxY | maxY50 |
| maxZ | maxZ50 |
| maxPitch | maxPitch50 |
| maxYaw | maxYaw50 |
| maxRoll | maxRoll50 |
| totalRangeXYZ | totalRangeXYZ50 |
| totalRangePYR | totalRangePYR50 |
| biteShapeRank | biteShapeRank50 |
| kurtosisX | kurtosisX50 |
| kurtosisY | kurtosisY50 |
| kurtosisZ | kurtosisZ50 |
| kurtosisPitch | kurtosisPitch50 |
| kurtosisYaw | kurtosisYaw50 |
| kurtosisRoll | kurtosisRoll50 |
| stdDevXYZ | stdDevXYZ50 |
| stdDevPYR | stdDevPYR50 |
| meanXYZ | meanXYZ50 |
| meanPYR | meanPYR50 |
| zeroCrossingsX | zeroCrossingsX50 |
| zeroCrossingsY | zeroCrossingsY50 |
| zeroCrossingsZ | zeroCrossingsZ50 |
| zeroCrossingsPitch | zeroCrossingsPitch50 |
| zeroCrossingsYaw | zeroCrossingsYaw50 |
| zeroCrossingsRoll | zeroCrossingsRoll50 |
| maxTimeBetweenZero-CrossingsX | maxTimeBetweenZeroCrossingsX50 |
| maxTimeBetweenZero-CrossingsY | maxTimeBetweenZeroCrossingsY50 |
| maxTimeBetweenZero-CrossingsZ | maxTimeBetweenZeroCrossingsZ50 |
| maxTimeBetweenZeroCrossings-Pitch | maxTimeBetweenZeroCrossings-Pitch50 |
| maxTimeBetweenZeroCrossings-Yaw | maxTimeBetweenZeroCrossingsYaw-50 |
| maxTimeBetweenZeroCrossings-Roll | maxTimeBetweenZeroCrossingsRoll-50 |
| numberOfPeaksX | numberOfPeaksX50 |
| numberOfPeaksY | numberOfPeaksY50 |
| numberOfPeaksZ | numberOfPeaksZ50 |

TABLE 1-continued

| mean | |
|---|---|
| numberOfPeaksPitch | numberOfPeaksPitch50 |
| numberOfPeaksYaw | numberOfPeaksYaw50 |
| numberOfPeaksRoll | numberOfPeaksRoll50 |
| manipulationRatio | manipulationRatio50 |
| linearAcceleration | linearAcceleration50 |
| wristRollMotion | wristRollMotion50 |

The sample features shown in Table 1 describe the X, Y, Z, pitch, yaw and roll motions that may occur within each bite window, for example, a 10 second bite window, or other interval as appropriate, continuously collected from initiation of the movement to the end of the movement, or for the given window of time. These features may include, for example, mean, standard deviation, pairwise covariance, number of 0 crossings, number of peaks, signal energy and spectral entropy. These features may also include, for example, a manipulation ratio that describes the ratio of angular motion to linear motion, a measure of linear acceleration that characterizes the strength of acceleration in a given direction, a wrist roll motion that characterizes how much a rolling motion varies from its average, and kurtosis that describes the shape of the graph. The features may be calculated across the entire window, as well as for the middle 50%, or other relevant segment as appropriate, of the bite window. In Table 1, a "50" at the end of any of the feature names indicates that particular feature is calculated on the middle 50%. However, features may be calculated based on another relevant segment of the bite window if appropriate, based on a particular user's bite motions and patterns.

The sample features shown in Table 1 may be processed by a machine learning type module of the algorithm, and in particular, a machine learning model developed for the processing of this type of data, such as a model employing the principles of, for example, a Naive Bayes Machine Learning type model, or other type of model capable of predicting whether, in a given ten second window of data, an actual bite action has occurred. This type of modeling may form the basis for the recognition model and algorithm used by the HTM counter 100/HTM device 200. This individualized machine learning model allows for the recognition model to continue to be updated and refined, in essentially real time, based on the user's specific movements and habits, repetition of specific movement and habits, and the like, without disruption in the use of the device. In this context, this continuous updating and refinement of the model may be done automatically by the model itself at a set interval, or each time a set amount of updated data/information has been collected, or each time a single item of updated data/information is collected, or other arrangement as appropriate. Regardless of the arrangement for this continuous updating and refinement, this process is carried out on board, by the processor 130 itself. That is, operation of the HTM counter 100/HTM device 200 does not need to be disrupted and hooked up or otherwise connected to any type of external device for periodic recalibration to achieve this level of well refined, personalized recognition of bites and discrimination between bites and non-bites.

Without the need for constant, scheduled recalibration and updating through separate, deliberate user intervention which disrupts regular operation of the device, user convenience, utility, and functionality of the model, and the HTM counter 100/HTM device 200 may be enhanced, with the model able to update itself and refine its own processes as it continues to gather more and more information through continued use, thus "learning" from its own experience. This allows the model to continuously improve accuracy and also adapt as the user's motions change. This does not simply amount to an adjustment of threshold values, as would a regular re-calibration of this type of device. Rather, this approach automatically captures the many subtleties of the motions of an individual user, yielding a much more personalized and intuitive device, which is not calibrated, but instead learns from the individual's particular motions and improves itself.

In some embodiments, the model implemented by the HTM counter 100 may employ a smaller number of features, for example, a subset of the sample features shown in Table 1, in the interest of computational efficiency. For example, in one embodiment, the model may select five features, as shown in Table 2, which the model may determine to be most critical in characterizing arm/hand movement defining an actual, confirmed bite action. Again, data associated with the subset of features may be captured by the sensing device 120 and processed by the processor 130, which are continuously in operation, beginning at a point in time at which the sensing device 120 senses a motion, particularly, a motion in a direction corresponding in a hand to mouth movement, has been initiated, and continue capturing this data until the sensing device 120 senses that the motion has been completed. In some embodiments, the data collection period corresponding to a bite window may be characterized by a given interval of time representing the bite motion, from initiation to completion. In some embodiments, this interval may be, for example, 10 seconds. Other intervals may also be appropriate, depending on a particular user's habits and patterns, and other such factors.

A number of different mechanisms may be applied in selecting this subset of features from the large group of sample features, which may be collected by the sensing device 120 and processed by the processor 130 as described above. For example, in one embodiment, the worth of a particular attribute may be evaluated by applying a support vector machine (SVM) classifier, which may rank all of the attributes by the square of the weight assigned by the SVM. By carefully selecting an appropriate subset of features from the large group of sample features shown in Table 1, so that the resulting data is most representative of an actual bite action, computational efficiency may be greatly improved, while sacrificing relatively little to nothing in accuracy. Table 2 provides one example in which 5 features have been selected from the large group of sample features in this manner. Although Table 1 lists 207 sample features and Table 2 lists 5 features selected from Table 1, either by an SVM classifier as described above or other mechanism as appropriate, Table 1 may include more, or fewer, features, and Table 2 may include more, or fewer, features, depending on an implementation of the device, the mechanism employed for selection of the subset of features, computational requirements, and other such factors as appropriate.

TABLE 2

| |
|---|
| numberOfPeaksZ50 |
| minZ50 |
| yawSpecEntropy |
| rollSpecEntropy50 |
| yawSignalEnergyMean |

The minimum value of the Z accelerometer, as well as the number of peaks for the Z accelerometer, may be taken in the middle 50% of the measurement window. Although the hand is almost constantly rotating during a bite motion, the majority of the Z accelerometer's data characterizes acceleration on the vertical axis (see FIG. 5).

In deriving spectral entropy, first each series of data points, x[n], is converted from their domain to the frequency domain with a one dimensional Discrete Fourier Transform (Equation 1). The squared absolute value of the result gives the power spectrum (Equation 2), which is then normalized to become a probability density function (Equation 3). Finally, the entropy of this value is then calculated to produce the spectral entropy (Equation 4).

$$X(f) = DFT(x[n]) \tag{1}$$

$$PSD(f) = |X(f)|^2 \tag{2}$$

$$PSD_n(f) = \frac{PSD(f)}{\sum_{f=-\frac{f_s}{2}}^{f=\frac{f_s}{2}} PSD(f)} \tag{3}$$

$$SpecEntropy = -\sum_{f=-\frac{f_s}{2}}^{f=\frac{f_s}{2}} PSD_n(f)\log_2[PSD_n(f)] \tag{4}$$

Spectral entropy may provide a measure of the disorder or unpredictability of the past data set. The roll (in the middle 50% section) and yaw angular accelerations were selected, as these features provided a revealing measure of the relative disorder of their measurements within the 10-second window.

The signal energy mean was also measured for the yaw angular velocity across the 10-second window. The signal energy mean may be calculated by taking the absolute value of the first value of the fast Fourier transform on the given data set (Equation 5).

$$\text{SignalEnergyMean}=|X(f)|[1] \tag{5}$$

The Signal Energy Mean may measure the average energy in the given data set. Movement energy along the yaw axis was among the most revealing, or most predictive, calculated features.

The HTM counter 100, in accordance with embodiments as broadly described herein, may employ this carefully selected subset of features to detect hand to mouth bite motions and carefully discriminate between bite and non-bite motions, with great accuracy when the subset of features are properly selected through, for example, 10-fold cross validation of data collected by the HTM counter 100, using the base recognition model. This type of recognition may be performed on, for example, a new/not previously tested subject pool, including, for example, a mix of males and females of different ethnicities, for greater than 10 subjects over greater than 15 of meals including greater than 1400 bite instances. Results of the cross validation are shown in Table 3.

TABLE 3

| | 10 Hz Data Recording |
|---|---|
| 10-fold Cross Validation (All Sample Features) | 85.94% |
| Test Suite 1 (All Sample Features) | 85.97% |
| Test Suite 2 (All Sample Features) | 80.66% |

TABLE 3-continued

| | 10 Hz Data Recording |
|---|---|
| 10-fold Cross Validation (Subset of Features) | 92.05% |
| Test Suite 1 (Subset of Features) | 89.05% |
| Test Suite 2 (Subset of Features) | 81.20% |

As shown in Table 3, the HTM counter 100 may implement this type of model, monitoring hand to mouth movement continuously throughout the day, regardless of activity, and collecting data accordingly, so that both bite and non-bite motions may be accurately recognized and counted throughout the day with relatively high accuracy, while relying on only a subset of features. Bite recognition provided by the HTM counter 100 when relying on only a subset of features is high relative to the results achieved when relying on the full complement of features, especially when balanced against the significant increase in computational efficiency due to the reduced number of features. When taking into consideration the substantial additional increase in efficiency due to the user's personalization of the HTM counter 100 when initially operating in the learning mode to train the device to the user's specific characteristics and style, accuracy may be enhanced even further.

The recognition model may thus recognize and classify bites in real time, with accuracy improved by personalization and training of the HTM device in the learning mode. The algorithm may, over time, learn to recognize periods of eating throughout the user's day, and constantly update the model to reflect these patterns. The algorithm may constantly window the data and calculate statistics to continuously refine its ability to positively and accurately detect bites. In some embodiments, the algorithm may make use of a subsets of the various sensors included in the sensing device, to save power in periods of time when it is not needed. For example, power consumption of the gyroscope may, in certain implementations, be significantly higher than that of the accelerometer, so the gyroscope could be turned off for known non-meal periods, based on the learned and/or entered user patterns of behavior. For example, in some embodiments, these algorithms may intelligently wait for several bites to be taken in relatively quick succession before allowing bites to be freely recognized by the machine learning model, to help prevent the device from counting false outlier bite motions and further improve overall device accuracy.

As noted above, in order to personalize the HTM device for a particular user and improve bite motion detection accuracy, the device may include a personalization mode, in which a set of personalized data may be collected from the user to develop a personal profile. The personalization mode may be enabled at various different times, including, for example, prior to initiating use of the device, before or during operation in the learning mode, and any time the user wishes to update the personal profile to reflect changes in lifestyle, eating habits and the like which may affect how bites are discriminated from non-bites, and how and when bites are counted. Data collected during the personalization mode in developing the personal profile may include, for example, age, sex, left/right handedness, nationality, preferred meal times, preferred dishes, preferred eating utensils, and other such questions which may have an effect on arm/hand motion while eating. Based on the user's personal profile, the model may, for example, reverse the axis, about which the accelerometer measures movement/velocity and the gyroscope measures direction, in the case of left-handedness, and may cause the model to be more likely to accept bite motions closer to the times specified as normal meal times, in particular in cases where parameters of a detected movement border the characteristics of a bite action and a non-bite action. During operation in the learning mode, the user may perform several examples of bite motions and similar non-bite motions for storage in the model, and some confirmation of bites/non-bites in areas that require additional data and/or are outside of established or already collected data. This initialization data may be used to adjust the model, in conjunction with training data while operating in the learning mode, to further personalize the HTM device for the user and improve overall accuracy of the device. These refinements may make the device more effective in accurately distinguishing between a bite and non-bite action, allowing the HTM device to be worn all day and detect both planned and opportunistic eating without user interaction, and without the user activating the device at the beginning of an eating period and deactivating the device at the end of the eating period. Data collected in the learning/personalization mode may also be taken into consideration when further refining which of the sample features shown in Table 1 may be included in the subset of features to best characterize a particular user's bite motion.

As noted above, the HTM device may communicate with an external computing device, such as, for example, a smart phone, a tablet device, a laptop computer, a desktop computer and the like. In some embodiments, the algorithms and models described above may be embedded in an application on the paired computing device, and data may be presented to/viewed by/manipulated by the user through a GUI rendered by the computing device to facilitate use, learning, and feedback. The computing device may log and process data over long periods of time to develop historical trends, generate predictive trends, set and alter goals, and save the data in a quickly accessible form. Use of a machine learning model, such as the Naive Bayes model, which is not processing intensive, and reliance on a reduced number (five) of calculated features of the detected movement, battery power, processing capability and speed, and memory management may present little to no issue in the implementation of the HTM device.

Figure 6:
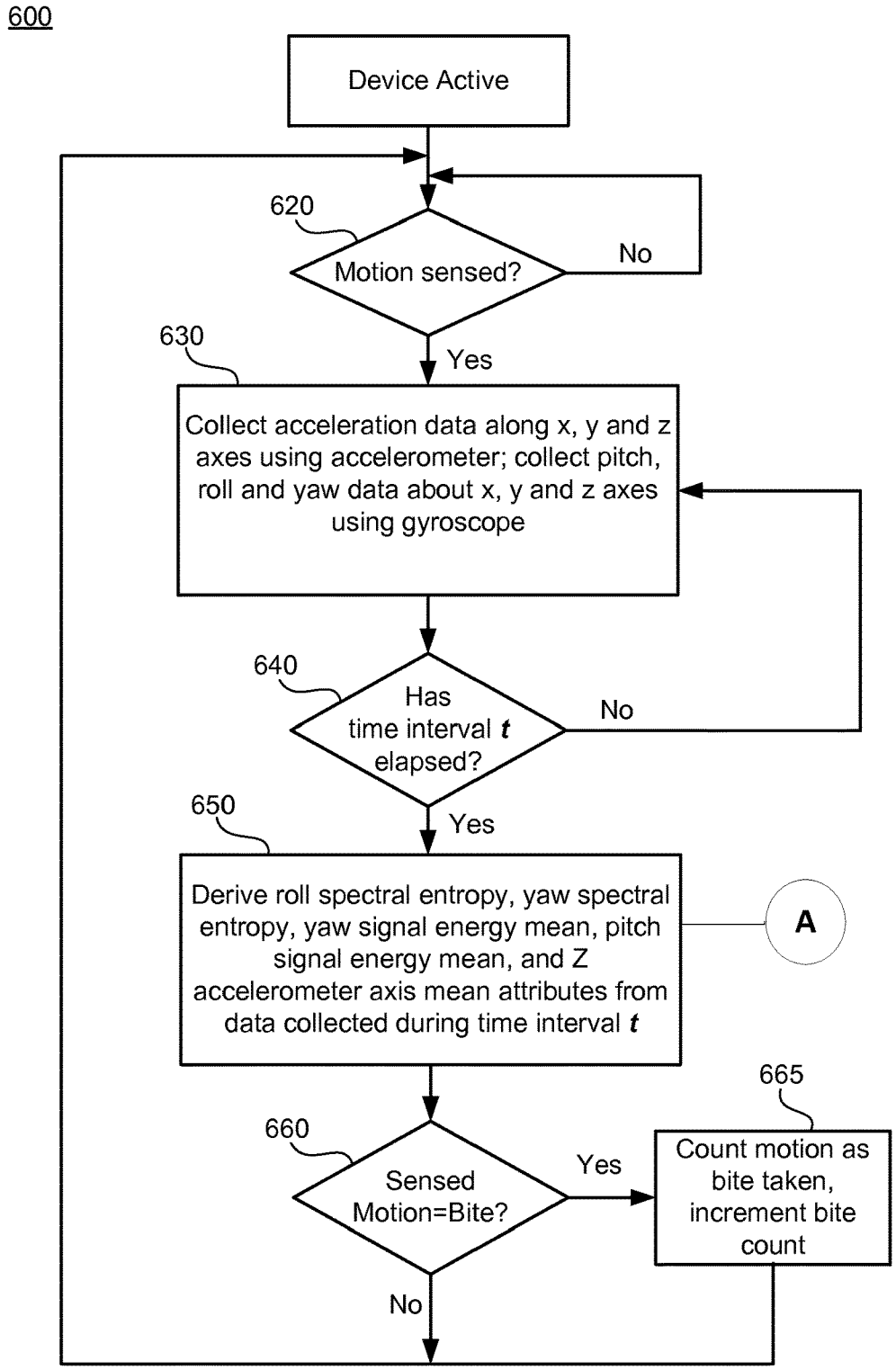
FIG. 6 is a flowchart of an example method of operation of a hand to mouth counter, in accordance with embodiments as broadly described herein.

An example operation method 600 for operation of a hand to mouth bite counting device, in accordance with embodiments as broadly described herein, is shown in FIG. 6. When the device is active and a motion is sensed at block 620, the sensing device collects acceleration data along the X-, Y- and Z-axes using the accelerometer, and collects pitch, roll and yaw data using the gyroscope at block 630. A set of attributes including roll spectral entropy, yaw spectral entropy, yaw signal energy mean, pitch signal energy mean, and Z accelerometer axis mean are derived from data collected during a set time interval t at blocks 640 and 650. If, at block 660, it is determined, based on the attributes derived at block 650, that the sensed motion is an actual bite taken by the user, then the bite counter is incremented to reflect the additional bite at block 665. This process is repeated until the device is no longer active.

Figure 8:
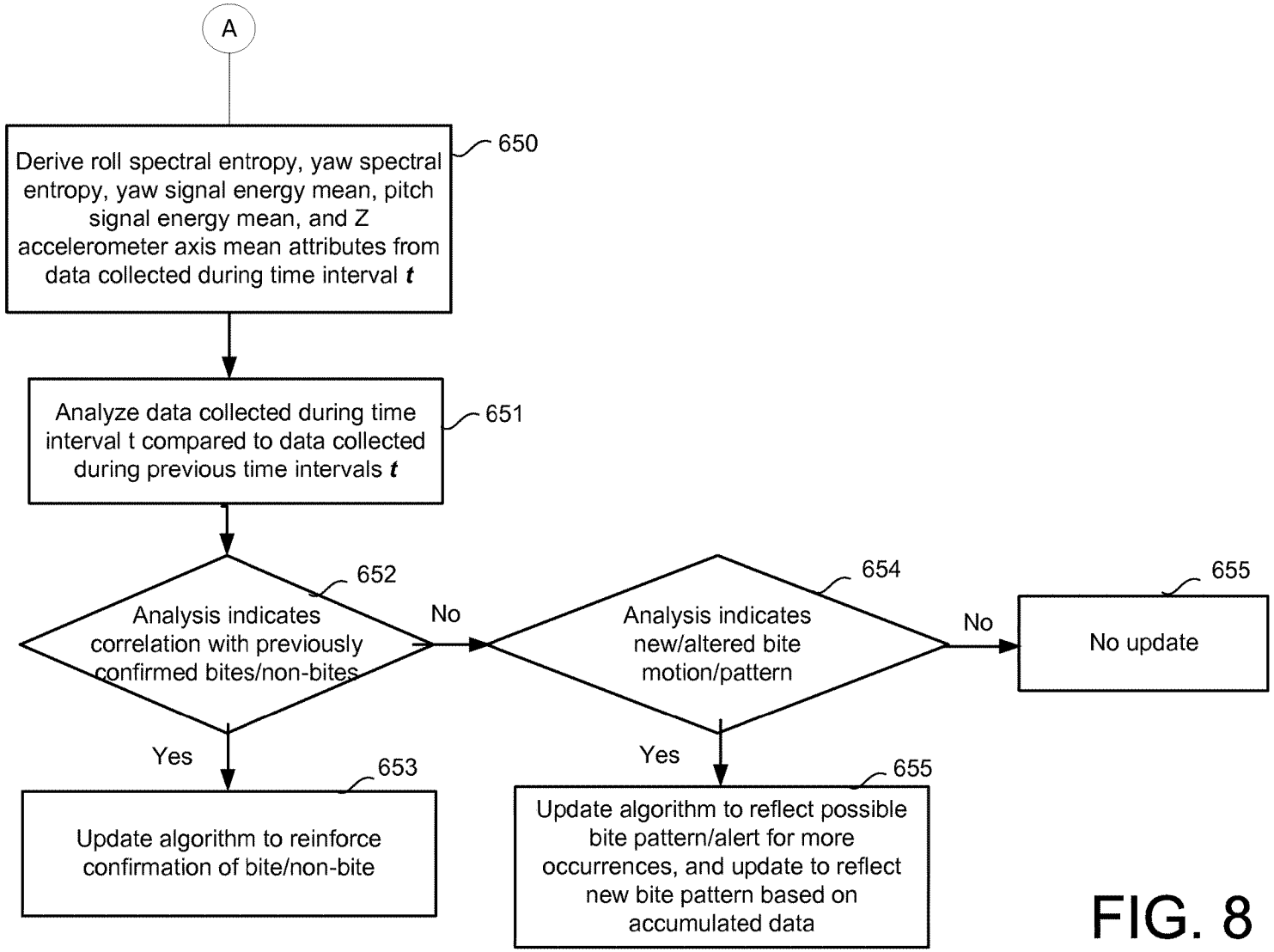
FIG. 8 is a flowchart of an example method of a learning and updating process of a hand to mouth counter, in accordance with embodiments broadly described herein.

During the analysis of the collected data conducted by the processor at block 650, the processor 130 may also analyze the data to determine if the data collected during a particular time interval t reflects a new pattern or motion, and if the possible new pattern or motion may correspond to an actual bite taken by the user, so that the algorithm, and the HTM counter 100/HTM device 200 may be updated as appropriate. For example, as shown in FIG. 8, the processor may analyze data collected during a current time interval t compared to data collected during previous time intervals t at block 651. If, at block 652, the processor correlates the current data with previously confirmed bites/non-bites, the processor may update the algorithm at block 653 to reinforce confirmation of the observed bite/non-bite motion. If, at block 654, the processor determines that the current data may correspond to a new or altered bite motion or pattern, the processor may update the algorithm at block 655 to indicate that a new bite motion or pattern may have been observed, and may generate a flag or alert for more occurrences, so that a new bite pattern or motion may be added as appropriate as more data is collected. Otherwise, the collected date is recognized as a non-bite at block 656.

Figure 7:
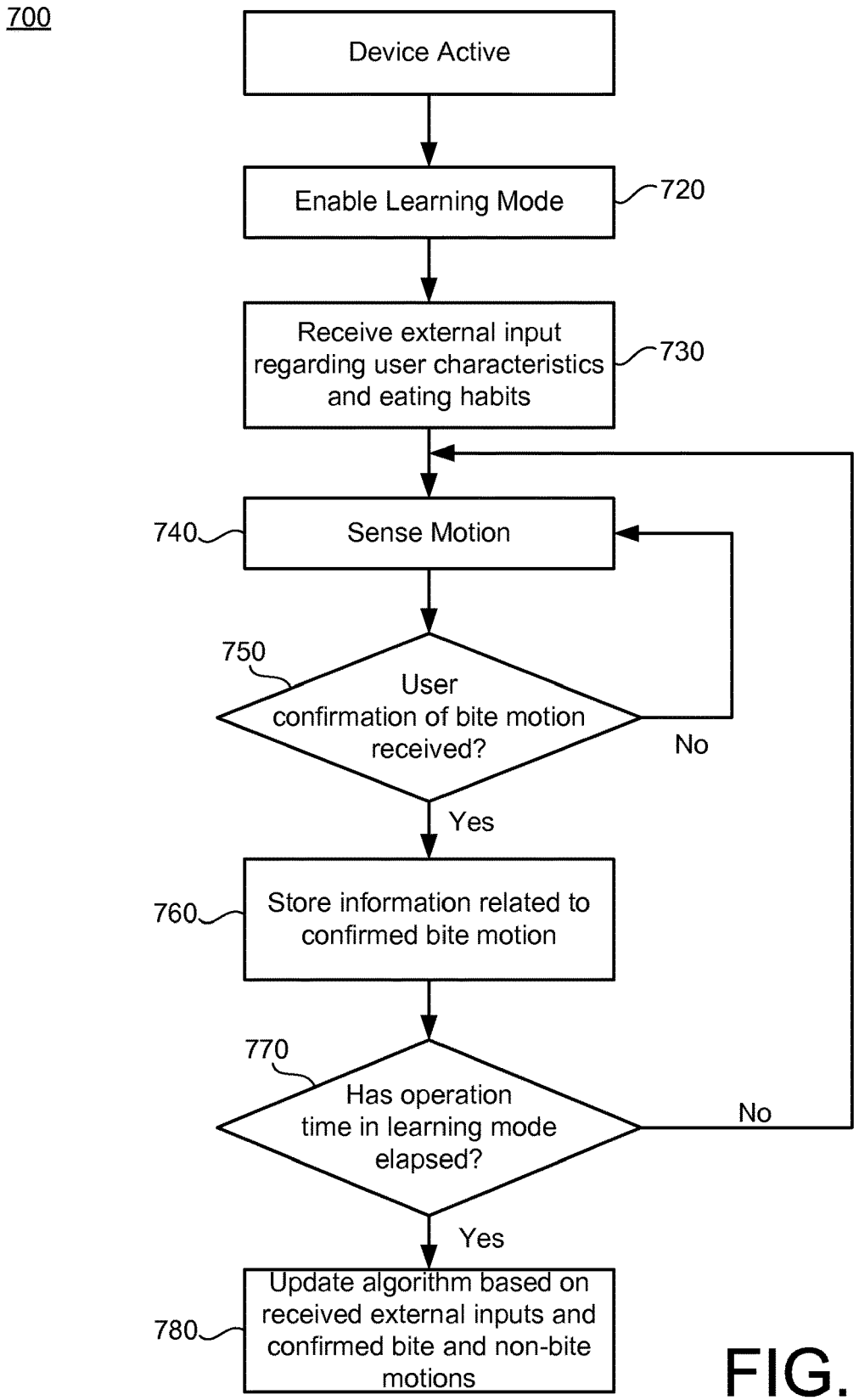
FIG. 7 is a flowchart of an example method of operation of a hand to mouth counter in a learning mode, in accordance with embodiments broadly described herein.

An example operation method 700 for operation of a hand to mouth bite counting device in a learning mode, in accordance with embodiments as broadly described herein, is shown in FIG. 7. When the device is active and the learning mode is enabled at block 720, external input regarding user characteristics and eating habits is requested, received and stored at block 730. As noted above, these user characteristics and eating habits may include, for example, age, gender, nationality, right or left handedness, preferred meal times, preferred cuisine/meals, preferred eating utensils including for example chopsticks, and other such personalized features. While still in the learning mode, if a motion is sensed at block 740, user confirmation that the sensed motion is an actual bite is requested at block 750. As noted above, the sensed motion may be conducted in response to a request from the device that the user perform a particular motion, or a motion conducted by the user independently. If the sensed motion is confirmed to be an actual bite, information related to the confirmed bite motion is stored at block 760. The algorithm is updated based on the received external inputs and the confirmed bite motions when the operation time in the learning mode has elapsed at blocks 780 and 790.

As noted above, this initial user baseline may be used to improve the base recognition model, which is operational out of the box, by positively capturing, for example, frequently used, known motions, together with personalized features. The recognition model is further, and continuously improved, and made more accurate, as the device continues to be used in the operational mode, additional data is collected, and the algorithm is automatically updated. This process is very organic, and can naturally capture the wide variety of human movement. It does not rely on threshold values but captures entire motions for learning and recognition purposes.

During operation in both the learning and/or personalization mode, and during regular operation, movements captured by the HTM counter 110/HTM device 200, both for training and classification, are continuous and natural, with no pre-established thresholds that need to be maintained for continued proper operation of the device. For example, if the user notices that the HTM counter 100/HTM device 200 has mis-detected a particular movement as a bite or a non-bite, the user may simply repeat the mis-detected motion in learning mode and the model will intelligently update itself so that that particular motion and all motions closely related to that particular motion will be more often grouped to whichever category (bite or non-bite) the user positively assigned. This process may be extremely intuitive for the user, as the user moves naturally to capture and train the model, a mis-detection or mis-labeling being easily recognizable and correctable. The model may recognize a full range of motion of a user's arm and employs its current understanding of the arm's motion to classify movements.

The organic nature of the machine learning model may allow the model to drastically improve accuracy and personalize itself to each individual user.

As noted above, the user may use the HTM counter 100/HTM device 200 to set, monitor and change specific goals, on, for example, a daily, weekly, monthly and/or yearly basis, or other interval as appropriate for a particular user's circumstances. In some situations, these goals may be relative type goals, such as, for example, increasing or decreasing a number of bites taken during a particular interval, or maintaining a particular number of bites within a given interval. These goals may be set so as to represent hard daily calorie count goals. After settings goals appropriate to the particular user's situation in the initial learning mode and/or personalization mode, the device may generate various different types of alerts as the user approaches one of these goals. These types of alerts may include, for example, an audio type alert, a visual type alert displayed on the display of the device, a movement type alert such as a vibration of the device, and other such alerts. Regardless of the type of alert, in setting and updating goals, the user may also select intervals related to these alerts. For example, the user may set the device so that an alert is generated as the user approaches 75% of the allotted bites for a given day, with additional reminders at intermediate intervals prior to reaching 100% of the allotted bites for the day. Although the device may remain relatively silent and unobtrusive throughout the day. these types of alerts may be selected to improve the user's consciousness of bites, and corresponding eating habits throughout the day, further facilitating the user's achievement of short and long term weight management goals. In some embodiments, the device may be initialized by the manufacturer in a relative counting and decreasing mode, so that the device is operable out of the box. However, specific user input and customization of goals and the like may provide significantly more flexibility and effectiveness.

Implementations of the various techniques described herein may be implemented in digital electronic circuitry, or in computer hardware, firmware, software, or in combinations thereof. Implementations may implemented as a computer program product, i.e., a computer program tangibly embodied in an information carrier, e.g., in a machine-readable storage device (computer-readable medium), for processing by, or to control the operation of, data processing apparatus, e.g., a programmable processor, a computing device, or multiple computing devices. Thus, a computer-readable storage medium may be configured to store instructions that when executed cause a processor (e.g., a processor at a host device, a processor at a client device) to perform a process. A computer program, or algorithm, as described above, may be written in any form of programming language, including compiled or interpreted languages, and may be deployed in any form, including as a stand-alone program or as a module, component, subroutine, or other unit suitable for use in a computing environment. A computer program may be deployed to be processed on one computing device or on multiple computing devices at one site or distributed across multiple sites and interconnected by a communication network.

Method steps may be performed by one or more programmable processors executing a computer program to perform functions by operating on input data and generating output. Method steps also may be performed by, and an apparatus may be implemented as, special purpose logic circuitry, e.g., an FPGA (field programmable gate array) or an ASIC (application-specific integrated circuit).

Processors suitable for the processing of a computer program or algorithm may include, by way of example, both general and special purpose microprocessors, and any one or more processors of any kind of digital computing device. Generally, a processor will receive instructions and data from a read-only memory or a random access memory or both. Elements of a computing device may include at least one processor for executing instructions and one or more memory devices for storing instructions and data. Generally, a computing device also may include, or be operatively coupled to receive data from or transfer data to, or both, one or more mass storage devices for storing data, e.g., magnetic, magneto-optical disks, or optical disks. Data also could be transmitted to a companion device for processing/computation. The computation could happen on the device itself, on the companion device, on using a combination of the two. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory may be supplemented by, or incorporated in special purpose logic circuitry.

To provide for interaction with a user, implementations may be implemented on a computing device having a display device, e.g., a cathode ray tube (CRT), a light emitting diode (LED), or liquid crystal display (LCD) monitor, for displaying information to the user and an interface and/or input device by which the user can provide input to the computing device. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or."

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. A hand to mouth bite counting device, comprising:

a sensing device included in a housing, the sensing device continuously collecting data corresponding to a sensed movement of at least some portion of an arm of a user;

a processor operably coupled to the sensing device to determine whether data collected by the sensing device throughout the sensed movement corresponds to a bite of food taken by the user; and an interface device operably coupled to the processor, the interface device providing for communication between the user and the processor, wherein a set of attributes are derived from the data collected by the sensing device, the set of attributes defining the sensed movement from an initial point at which the sensed movement is initially sensed to a terminal point at which the sensed movement has terminated, the set of attributes including at least one of a spectral entropy characteristic of the sensed movement, a signal energy characteristic of the sensed movement, or a mean acceleration of the sensed movement.

2. The device of claim 1, wherein the sensing device is configured to begin collecting data each time a movement of at least some portion of the arm of the user is sensed, beginning at the initial point at which the sensed movement is sensed, and to continuously collect data for a predetermined interval of time, the predetermined interval of time corresponding to a completion of a hand to mouth motion.

3. The device of claim 1, wherein the sensing device includes:

an accelerometer configured to continuously measure an acceleration component of the sensed movement in at least one of an X-axis direction, a Y-axis direction, or a Z-axis direction, from the initial point of the sensed movement to the terminal point of the sensed movement; and a gyroscope configured to continuously measure a rotation component of the sensed movement about at least one of the X-axis, the Y-axis or the Z-axis, from the initial point of the sensed movement to the terminal point of the sensed movement.

4. The device of claim 3, wherein the mean acceleration of the sensed movement is characterized along the Z-axis.

5. The device of claim 4, wherein the spectral entropy characteristic includes at least one of a roll spectral entropy attribute, a pitch spectral entropy attribute, or a yaw spectral entropy attribute, and the signal energy characteristic includes at least one of a yaw signal energy mean attribute, a roll signal energy mean attribute, or a pitch signal energy mean attribute.

6. The device of claim 3, wherein the hand to mouth bite counting device is configured to operate in a personalization mode, a learning mode and an automatic mode, wherein, in the learning mode and in the personalization mode, the processor is configured to receive external user input confirming bite motions, and to receive external user input providing personal user characteristics to initialize a baseline user profile.

7. The device of claim 1, wherein an algorithm implemented by the processor on the data collected by the sensing device is continuously and automatically updated based on the data collected by the sensing device.

8. An operation method for a hand to mouth bite counting device, the bite counting device including a sensing device in communication with a processor, the method comprising:

activating the sensing device and continuously collecting data using the sensing device; and transmitting the data collected by the sensing device to the processor, and implementing an algorithm on the data collected by the sensing device, the algorithm comprising:

processing the data collected by the sensing device during a plurality of intervals of time;

deriving a set of attributes for a first interval of time, of the plurality of intervals of time, from the data collected by the sensing device during the first interval of time, the set of attributes defining a movement sensed during the first interval of time, the movement sensed during the first interval of time corresponding to a movement of at least a portion of an arm of a user, from an initial point of the movement sensed during the first interval of time to a terminal point of the movement sensed during the first interval of time;

processing the set of attributes, including deriving at least one of a spectral entropy characteristic of the movement sensed during the first interval of time, a signal energy characteristic of the movement sensed during the first interval of time, or a mean acceleration of the movement sensed during the first interval of time; and determining whether the movement sensed during the first interval of time is a bite of food taken by the user based on the set of attributes derived from the data collected by the sensing device during the first interval of time.

9. The method of claim 8, the method further comprising, for remaining intervals of time of the plurality of intervals of time, repeatedly:

deriving a set of attributes for each of the remaining intervals of time from the data collected by the sensing device, each set of attributes defining the movement sensed during a respective interval of time from an initial point of the movement sensed during the respective interval of time to a terminal point of the movement sensed during the respective interval of time; and processing the set of attributes and determining whether the movement sensed during the respective interval of time is a bite of food taken by the user based on the set of attributes derived from the data collected by the sensing device during the respective interval of time.

10. The method of claim 9, further comprising:

automatically updating the algorithm based on the data collected by the sensing device and the sets of attributes; and automatically applying the updated algorithm to data collected by the sensing device during subsequent intervals of time.

11. The method of claim 8, wherein activating the sensing device and continuously collecting data includes:

activating an accelerometer and continuously measuring an acceleration component of the movement sensed during the first interval of time in at least one of an X-axis direction, a Y-axis direction, or a Z-axis direction, from the initial point to the terminal point of the movement sensed during the first interval of time; and activating a gyroscope and continuously measuring a rotation component of the movement sensed during the first interval of time about at least one of the X-axis, the Y-axis or the Z-axis, from the initial point to the terminal point of the movement sensed during the first interval of time.

12. The method of claim 11, wherein a mean acceleration of the movement sensed during the first interval of time is characterized along the Z-axis.

13. The method of claim 12, wherein deriving a spectral entropy characteristic includes deriving at least one of a roll spectral entropy attribute, a pitch spectral entropy attribute, or a yaw spectral entropy attribute, and deriving a signal energy characteristic includes deriving at least one of a yaw signal energy mean attribute, a pitch signal energy mean attribute, or a roll signal energy mean attribute.

14. The method of claim 13, wherein deriving the roll spectral entropy attribute includes deriving a level of disorder in a measure of roll angular acceleration about the Y-axis, deriving the pitch spectral entropy attribute includes deriving a level of disorder in a measure of pitch angular acceleration about the X-axis, and deriving the yaw spectral entropy attribute includes deriving a level of disorder in a yaw angular acceleration about the Z-axis.

15. The method of claim 13, wherein deriving the yaw signal energy mean attribute, the pitch signal energy mean attribute and the roll signal energy mean attribute include deriving an average energy of the sensed movement along the X-axis, the Y-axis and the Z-axis.

16. The method of claim 8, wherein the method further includes operating in a learning mode of the device, including:

receiving a plurality of external user inputs, the plurality of external user inputs including confirmation of bite motions in response to motions sensed by the sensing device during operation in the learning mode; and updating the algorithm based on data collected by the sensing device while operating in the learning mode.

17. The method of claim 16, wherein the method further includes operating in a personalization mode, including:

receiving a plurality of external user inputs defining personal user characteristics, user demographic information and eating habits; and updating the algorithm based on data collected by the sensing device while operating in the personalization mode.

18. The method of claim 17, wherein operating in the learning mode and operating in the personalization mode includes:

operating in an initial learning mode and operating in an initial personalization mode;

developing a baseline user profile based on external inputs received during operation in the initial learning mode and operation in the initial personalization mode; and updating the algorithm based on the baseline user profile.

19. The method of claim 18, wherein operating in the learning mode also includes operating in a continuous learning mode, comprising:

processing, by the processor, current data collected by the sensing device;

analyzing, by the processor, the current data collected by the sensing device and previous data collected by the sensing device; and updating, by the processor, the algorithm based on the analysis.

20. The method of claim 19. wherein updating the algorithm based on the analysis comprises updating the algorithm at a predetermined interval, the predetermined interval being at least one of after a preset number of updates are collected and stored based on the analysis of the current data collected by the sensing device and the previous data collected by the sensing device; or after a preset period of time has elapsed.

* * * * *